US005750325A

United States Patent [19]

Szajewski

[11] Patent Number: 5,750,325

[45] Date of Patent: *May 12, 1998

[54] PHOTOGRAPHIC ELEMENT CONTAINING HIGH CHLORIDE TABULAR GRAIN SILVER HALIDE EMULSIONS WITH [111] CRYSTALLOGRAPHIC FACES

[75] Inventor: Richard Peter Szajewski, Rochester, N.Y.

[73] Assignee: Eastman Kodak Company, Rochester, N.Y.

[ * ] Notice: The term of this patent shall not extend beyond the expiration date of Pat. No. 5,508,160.

[21] Appl. No.: 804,770

[22] Filed: Feb. 24, 1997

Related U.S. Application Data

[62] Division of Ser. No. 583,577, Jan. 5, 1996.

[51] Int. Cl.[6] ..... G03C 1/035

[52] U.S. Cl. ..... 430/567; 430/569

[58] Field of Search ..... 430/567, 501, 430/569

[56] References Cited

U.S. PATENT DOCUMENTS

| | | | |
|---|---|---|---|
| 4,952,491 | 8/1990 | Nishikawa et al. | 430/570 |
| 5,358,830 | 10/1994 | Twist | 430/373 |
| 5,418,117 | 5/1995 | Marsden | 430/373 |
| 5,443,944 | 8/1995 | Krafft et al. | 430/501 |
| 5,508,160 | 4/1996 | Maskasky | 430/567 |

*Primary Examiner*—Hoa Van Le
*Attorney, Agent, or Firm*—J. Lanny Tucker

[57] ABSTRACT

Photographic elements having bromide or iodide ion stabilized high chloride {111} tabular grain emulsions are rapidly processed. The emulsion grains comprise a high chloride core with a surrounding band of higher bromide or iodide ion than that found in the core. The emulsion is precipitated in the presence of an organic grain growth modifier or surface stabilizer. Specific developing conditions of temperature, time, bromide ion concentration, color developing agent concentration and ratio of developing agent to bromide ion allow for the rapid processing of these elements.

9 Claims, No Drawings

PHOTOGRAPHIC ELEMENT CONTAINING HIGH CHLORIDE TABULAR GRAIN SILVER HALIDE EMULSIONS WITH [111] CRYSTALLOGRAPHIC FACES

This is a Divisional Application of application Ser. No. 08/583,577, filed Jan., 5, 1996, recently allowed.

FIELD OF THE INVENTION

This invention relates to a light sensitive photographic element employing bromide or iodide ion stabilized high chloride {111} tabular grain emulsions and processes suitable for rapid photographic development and desilvering.

BACKGROUND OF THE INVENTION

High iodobromide tabular grain silver halide emulsions with {111} crystallographic faces are known to provide an improved balance of sensitivity and granularity along with improved image sharpness as described in U.S. Pat. No. 4,439,520 (Kofron et al). The predominately iodobromide emulsions described in this patent, however, are slow to develop and can be difficult to adequately bleach and fix when employed in color forming elements.

Attempts have been made to provide emulsions exhibiting all the desirable characteristics described in the noted patent, particularly excellent photographic sensitivity, while simultaneously providing improved developability and improved bleaching and fixing behavior by replacing some or all of the bromide and iodide ion of these emulsions with chloride ion. These early high chloride emulsions required the presence of a substituted hydrocarbon grain growth modifier to both enable growth of the morphologically unstable {111} form and to stabilize that grain form once present.

Nevertheless, these emulsions still suffered from a lack of morphological stability that limited their commercial utility because the emulsion dependent photographic properties would change drastically over time. Subsequently, attempts at providing high chloride {111} tabular emulsions have focused on improved grain growth modifiers and methods of morphological stabilization by providing various organic compounds that serve to better direct grain growth towards {111} tabular forms and to stabilize the grain surface as described, for example, in U.S. Pat. No. 5,176,991 (Jones), U.S. Pat. No. 5,176,992 (Maskasky) or U.S. Pat. No. 4,952,491 (Nishikawa et al). The first two patents do not have any specific teaching about preferred color development methods while the last one teaches the use of developer solutions containing little or no bromide ion.

While the grain growth control and morphological stability of the high chloride {111} tabular emulsions has been greatly advanced by these techniques, those emulsions with well-adhered organic surface stabilizer when coated in a photographic element still prove difficult to adequately develop and desilver, while those emulsions with poorly adhered or purposefully removed organic surface stabilizer still suffer from morphological instability. More recently, it has been reported in U.S. Pat. No. 5,035,992 (Houle et al), that improved morphological stability can be achieved with high chloride {111} grains of various morphologies by the expedient of incorporating a bromide or iodide band. Additional examples of bromide or iodide stabilized {111} high chloride tabular grain emulsions are illustrated in U.S. Pat. No. 5,217,858 (Maskasky) and U.S. Pat. No. 5,389,509 (Maskasky). The emulsions described in these patents still require the presence of a grain growth modifier to ensure formation of the {111} faced tabular shaped grains. Further, the application of these emulsions to camera speed color negative films is not described.

The use of specific developer formulations to provide rapid access has likewise been investigated. Cubic silver chloride emulsion grains again specifically precipitated with organic grain growth modifiers and described as corner development grains (CDGs) are disclosed in U.S. Pat. No. 4,820,624 (Hasebe et al) and U.S. Pat. No. 4,865,962 (Hasebe et al). When properly sensitized these symmetric CDG emulsions are said to provide improved sensitivity. Here, the developer solution employed to provide rapid access contains no restraining bromide ion. EP-A-0,468,780 (published 29 Jan., 1992) describes low bromide ion developer formulations said to be useful with color negative films employing cubic silver bromochloride emulsions. Although rapid development using a low bromide developer is described, the overall light sensitivity of these films is severely deficient. Further, it is taught in U.S. Pat. No. 5,354,649 (Bell et al) that the quantity of bromide in these emulsions is such as to lead to rapid deactivation of the developer solution employed as bromide ion washes out of the film and into the developer solution during a development step.

Cubic shaped silver chloride emulsions and useful development methods are disclosed in EP-A-0,466,417 (published 15 Jan., 1992), and in Japanese Kokai 04-101135 (published 2 Apr., 1992). Rapid access is apparently obtained in a low bromide color developer solution but only with relatively light insensitive emulsions unsuitable for use in a hand-held camera.

Other low bromide developer solutions suitable for color papers employing low sensitivity regular shaped high chloride emulsions are disclosed in U.S. Pat. No. 5,004,675 (Yoneyama et al), U.S. Pat. No. 5,066,571 (Yoshida et al), U.S. Pat. No. 5,070,003 (Naruse et al), U.S. Pat. No. 5,093,226 (Ohshima), U.S. Pat. No. 5,093,227 (Nakazyo et al), U.S. Pat. No. 5,108,877 (Asami), U.S. Pat. No. 5,110,713 (Yoshida et al), U.S. Pat. No. 5,110,714 (Furusawa et al), U.S. Pat. No. 5,118,592 (Hasebe), U.S. Pat. No. 5,153,108 (Ishikawa et al) and U.S. Pat. No. 5,162,195 (Inagaki). These publications teach that low quantities of bromide ion in the developer variously improve staining and pressure fog characteristics. Concentrations of bromide ion between about 0.05 mmol/l and about 1 mmol/l are described as optimal while bromide ion concentrations greater than about 1 mmol/l are discouraged since these are said to reduce sensitivity of the regular shaped emulsions. Additionally, higher quantities of bromide ion in a developer intended for low to no bromide ion containing high chloride regular shaped emulsions are known to lead to incorporation of bromide ion from the developer into undeveloped portions of the emulsion during a development step. This incorporation, known as metathesis, results in two related problems, that is the depletion of bromide ion from the developer which must then be replenished more often than typically desired and incorporation of the bromide ion into emulsion which must then be removed during a desilvering step where silver bromide is well known to be more difficult to remove than is silver chloride.

The continuing problem of providing rapidly developable camera speed color photographic elements is well expressed in U.S. Pat. No. 5,344,750 (Fujimoto et al) at column 1 (lines 35ff) where it is stated that "the high chloride emulsions used in color paper can be rapidly developed in comparison with silver halide emulsions containing silver iodide used in color negative films for photography, but sufficiently high sensitivity can not be obtained and hence the high silver chloride emulsions can not be used in the color negative films for photography." The use of highly light sensitive silver iodobromide emulsions in a camera speed film that is then processed at elevated temperatures in highly concentrated developing agent and bromide ion containing developer solutions is suggested as a means of resolving this long standing problem. The higher temperatures and otherwise tightly controlled developer solution composition required by this approach are difficult to provide especially since continuous processing leads to a steady decrease in developing agent and developer bromide ion concentration that results in unwanted degrees of fog growth. Further, the higher levels of iodide ion in the emulsions remove the possibility of ready and rapid desilvering with environmentally suitable agents. Thus, this proposal hardly fits with the public desire for the use of ecologically benign film process solutions.

Yet another means of resolving these difficulties is proposed in U.S. Pat. No. 5,354,649 (Bell et al) where the bromide ion content of the light sensitive emulsions and the developer solution are both said to be critical to the sensitivity issue and the developability issue. This patent proposes that photographic materials employing cubic silver iodochloride emulsions comprising only very limited quantities of bromide ion, when developed in a very low to no bromide ion developer solution can provide rapidly developable films of somewhat improved sensitivity. The desilvering problems inherent in high iodide emulsion elements are however still present. In an attempt to provide both normal development and rapid development with a common film element it is proposed in U.S. Pat. No. 5,382,501 (Inoie) that multilayer, multicolor camera speed elements employing specific twin-grain AgIBr emulsions where the iodide content of the emulsions employed in a more sensitive and a less sensitive blue light sensitive layers, is controlled within a narrow range can provide blue color unit gamma that is relatively insensitive to inverse changes in both development time and temperature.

All of these proposals fail in that, one or another requirement for a successful rapid access camera speed film and process is not met. Either camera speed in not attainable with the emulsions proposed or adequate gamma in the various color records to enable color printing is not achieved, or the emulsions are unstable, or the process proposed is inherently unstable or the processing schemes proposed result in a situation where the various color units disposed at differing physical depths in a multilayer multicolor film develop at differing rates and result in a wide spread in color unit developability and gamma thereby detracting from the utility of the formed image.

Thus a need still exists to provide a camera speed color element suitable for rapid access color development as well as a means of processing such a film element that enables even development throughout the various color records and further provides for rapid and complete desilvering of such an element.

SUMMARY OF THE INVENTION

It has now been discovered that the problems noted above are overcome with an image forming process comprising a developing step of contacting an imagewise exposed light sensitive photographic element with a developing solution, the element comprising a support having thereon one or more silver halide emulsion layers and a chemically and spectrally sensitized emulsion (A), characterized in that:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in the core, the band containing up to about 30 percent of the silver in the tabular grain, wherein the emulsion (A) has been precipitated in the presence of an organic grain growth modifier or surface stabilizer and wherein the organic grain growth modifier or stabilizer has been substantially removed from the emulsion (A) after the formation of the band; and wherein the contact time of the element with the developing solution is from about 10 to about 120 seconds, and the developing solution is characterized in that:

(1) the solution temperature is from about 25 to about 65° C.

(2) the solution comprises bromide ion at a concentration of from about 0.25 to about 50 mmol/l, (3) the solution comprises a color developing agent at a concentration of from about 1 to about 200 mmol/l, (4) the ratio of developing agent concentration to bromide ion concentration is from about 60:1 to about 1:2; and (5) the solution pH is from about 9 to about 12.

This invention further provides a light sensitive color photographic element comprising:

a support having thereon a red light-sensitive color record comprised of a red sensitized silver halide emulsion, a green light-sensitive color record comprised of a green sensitized silver halide emulsion, and a blue light-sensitive color record comprised of a blue sensitized silver halide emulsion, and a chemically and spectrally sensitized emulsion (A), wherein:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in the core, the band containing up to about 30 percent of the silver in the tabular grain, wherein the emulsion (A) has been precipitated in the presence of an organic grain growth modifier or surface stabilizer and wherein the organic grain growth modifier or stabilizer has been substantially removed from the emulsion (A) after the formation of the band, and wherein the element has a light sensitivity of at least ISO-25.

This invention provides a light sensitive photographic element employing high chloride {111} tabular grain emulsions exhibiting greatly shortened image processing times. The elements employing these tabular emulsions exhibit excellent photographic sensitivity and can be employed in a hand-held camera and are rapidly and evenly developable so as to provide a pleasingly balanced image. The {111} emulsions are surface stabilized thus providing for excellent keeping properties for both the emulsions themselves and for film elements employing the emulsions. These elements simultaneously allow for both improved development and greatly improved desilvering thus allowing the speedy attainment of high quality images. Specific methods of developing such elements are provided.

DETAILED DESCRIPTION OF THE INVENTION

Emulsion (A) useful in the practice of this invention comprises a chemically and spectrally sensitized tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in the core, the band containing up to about 30 percent of the silver in the tabular grain.

It is preferred that the element processed according to this invention have at least about 50% of the incorporated silver halide being accounted for by one or more of emulsions (A). The remaining silver halide can be in other conventional emulsions.

These grains have well-defined exterior crystal faces that lie in {111} crystallographic planes that are substantially parallel and the overall grain shape is tabular. Tabular grains are preferred in the practice of this invention since they provide improved sensitivity relative to the related {111} octahedral shaped or other {111} grains also known in the art. The tabular grains generally have a thickness of 0.5 μm or less, and preferably have a thickness of less than about 0.3 μm. Ultra-thin grains limited in thickness only by having a thickness of greater than about 0.01 μm are specifically contemplated. The grains will generally have a diameter of from about 0.2 to about 10 μm and preferably have a diameter of from about 0.4 to about 7 μm. The term aspect ratio refers to the ratio of the diameter of the grain to the thickness of the grain. The grains must have an aspect ratio of greater than about 2 and preferably have an aspect ratio greater than about 8. It is preferred that the aspect ratio be less than about 100.

Tabular grains can also be defined by their "tabularity" which is the ratio of the diameter to the square of the grain thickness. The emulsions useful in the practice of this invention will generally have a "tabularity" greater than about 5 and preferably greater than about 25. The "tabularity" will generally be less than about 15,000, preferably less than about 5,000 and most preferably less than about 1,000.

The grain shape criteria described above can be readily ascertained by procedures well known to those skilled in the art. For example, it is possible to determine the diameter and thickness of individual grains from shadowed electron micrographs of emulsion samples. The diameter of a tabular grain refers to the diameter of a circle equal in area to the projected area of that tabular grain. This diameter is often described as an equivalent circular diameter (ECD). Generally a tabular grain has two parallel faces and the thickness of the grain refers to the distance between the two parallel faces. The halide content of individual grains can be determined by well-known microprobe techniques while the halide content of an emulsion population generally follows from the details of precipitation and sensitization and can be verified by microprobe, atomic absorption or X-ray fluorescence techniques. From these measurements, the proportion of grains in an emulsion sample fulfilling the requirements of this invention can be determined. The average equivalent circular diameter of the grains in an emulsion sample is the average of the individual equivalent circular diameters of the grains in that sample. Similarly, the average grain thickness is the average of the grain thickness of the individual grains, the average aspect ratio is the average of the individual aspect ratios, and the average tabularity is the average of the individual tabularities. Such electron micrographs of {111} tabular emulsions, when viewed face-on, generally have the appearance of hexagons or tip-truncated hexagons of greater or lesser regularity. It is preferred that the coefficient-of-variation in the ECD or thickness of the grains in a useful emulsion population be less than about 60% and preferably less than about 30% as this provides improved tone scale, image granularity behavior and other properties as described in the art.

In the context of this invention, a band refers to a localized layer of silver halide deposited in a continuous fashion on a pre-formed silver halide grain core. The localized layer, or band, is preferably situated at or near the silver halide grain surface. When the band is deposited in a continuous fashion, it may fully enclose the core region or alternatively, it may encircle the core region forming a continuous ring-like deposit localized along the grain edges, or again alternatively it may form a continuous deposit on the grain faces. A core refers to the said pre-formed silver halide grain onto which the band is formed. The halide composition of the band and core regions of the grain are of different composition as dictated by the halide composition of the solutions used in the precipitation. The band is formed after at least 50 percent, but preferably 70 percent or more preferably 90 percent of the grain formation reaction, that is the grain precipitation, is completed. When the higher silver bromide or silver iodide band is formed before all of the silver salt solution has been added, it may be followed by a region of lower silver bromide or silver iodide proportion. Alternatively, the band may be formed after all of the silver salt solution has been added by the addition of a second salt solution wherein the solubility with silver ion of the second halide is sufficiently less than that of the first silver halide so that conversion of the surface silver halide layer will result. The grains may contain multiple bands around a central core and the bands may vary in the proportion of chloride, bromide and iodide. While the band may contain up to about 30 percent of the silver in the tabular grain, it is preferred that the band contain from about 0.1 to about 10 percent of the silver in the tabular grain, and even more preferred that the band contain from about 0.2 to about 3 percent of the silver in the tabular grain.

The high chloride tabular {111} grains with the bromide or iodide band useful in the practice of this invention can be prepared by precipitation procedures known in the art, or by obvious modifications of such procedures. Typically these procedures include the addition of any grain growth modifier known in the art. These grain growth modifiers or stabilizers can preferentially be chosen from among: the aminoazapyridine type compounds described in U.S. Pat. No. 4,801,523 and U.S. Pat. No. 4,804,621, the amino- and diamino-substituted pyrimidine type compounds described in U.S. Pat. No. 5,035,992, the 4,6-di(hydroamino)-5-aminopyrimidine, 6-aminopurine, 4-aminopteridine, and 8-azaadenine type compounds disclosed in U.S. Pat. No. 5,217,858, and the 7-azaindole type compounds disclosed in U.S. Pat. No. 5,389,509, all incorporated herein by reference. These grain growth modifiers are often pH sensitive and may be removed from the grains after a precipitation by adjusting the pH of the precipitation medium, typically water and gelatin, and washing as known in the art.

In another embodiment, the removable grain growth modifiers or stabilizers described in U.S. Pat. No. 4,952,490 and U.S. Pat. No. 4,952,491, both incorporated by reference, may be employed in conjunction with the oxidative grain growth modifier removal schemes suggested therein. Removal of substantially all of the organic grain growth modifier or stabilizer is preferred for emulsions to be employed in the practice of this invention since this removal aids in the desilvering steps typically employed during photographic processing of the light sensitive elements. The presence of the bromide or iodide band incorporated in the silver halide grains during the precipitation promotes the morphological stability of the grains thus formed.

The organic grain growth modifier or stabilizer is preferentially substantially removed from the emulsion grains after the formation of the band or shell. By substantially removed is meant that a sufficient proportion of the grain growth modifier or stabilizer is removed so that the development or desilvering steps of photographic processing are not hindered. This typically occurs when at least about 90% of the modifier or stabilizer is removed. It is preferred that at least 95% of the organic modifier or stabilizer be removed and more preferred that 99% be removed.

While either bromide or iodide ion can be used to stabilize the grain surface, the use of iodide ion for this function is preferred since the iodide band provides superior morphological stability to the otherwise unstable {111} grains. Additionally bromide and/or iodide ion may be incorporated in the emulsion in any manner known in the art. In particular, iodide may advantageously be present or added during emulsion grain preparation, particularly during the grain nucleation and grain growth steps, and during grain sensitization. When bromide or iodide ion, or both, are added during a grain growth step or for the purposes of band formation they may be added continuously as a halide run or may be added at discrete times as a halide dump. The halide ion may be supplied as soluble halide ion, as a sparingly soluble salt or by release from an organic carrier during an emulsion preparation step. Total emulsion iodide ion content should be less than about 5 mol percent, preferably less than about 2 mole percent and most preferably less than about 1 mole percent iodide ion, based on total silver, to ensure good development and desilvering characteristics. The remainder of the emulsion halide may be bromide ion that can be incorporated as described or in any manner known in the art. The emulsion may be chemically sensitized, doped or treated with various metals and sensitizers as known in the art, including iron, sulfur, selenium, iridium, gold, platinum or palladium so as to modify or improve its properties. The emulsions can also be reduction sensitized during the preparation of the grains by using thiourea dioxide and thiosulfonic acid according to the procedures in U.S. Pat. No. 5,061,614. The grains may be spectrally sensitized as is known in the art.

The light sensitive elements useful in the practice of this invention can be negative or positive working elements. In the preferred embodiment, the elements are negative working elements and are to be processed as negative working elements. These negative working elements are preferentially camera speed elements sufficiently light sensitive for use in a hand held camera, that is having a sensitivity of at least ISO-25 and preferably a sensitivity of at least ISO-100. In a less preferred mode they can be display elements, that is, elements having a lower sensitivity and intended for direct viewing.

The elements will be sensitive to that portion of the electromagnetic spectrum generally described as actinic radiation, that is to red, green, blue, infra-red or ultraviolet light or to combinations thereof. Red or red light means actinic radiation or light of a wavelength of from about 600 to about 700 nm, green or green light means light of a wavelength from about 500 to about 600 nm while blue or blue light means light with a wavelength of from about 400 to about 500 nm. Dyes that primarily absorb red light are referred to as cyan dyes, dyes which primarily absorb green light are referred to as magenta dyes and dyes that primarily absorb blue light are referred to as yellow dyes. Unless otherwise indicated, dye densities are reported as Status M densities the measurement of which is described at T. H. James, Ed., "The Theory of the Photographic Process," Macmillan, New York, 1977, 4th ed., page 520–521.

The camera speed color negative films useful in the practice of this invention typically comprise a support bearing a red light sensitive color record capable of forming a cyan dye deposit, a green light sensitive color record capable of forming a magenta dye deposit and a blue light sensitive color record capable of forming a yellow dye deposit. Each color unit can be comprised of one layer or of two, three, four or more discrete layers. The layers of a color unit can be contiguous or can be separated by non-light sensitive layers or by layers associated with a different color forming unit, all as known in the art. While the sensitivities of the individual color units are as described above, in a preferred mode, the blue sensitive layer has a broad sensitivity of from about 440 to about 480 nm, the green sensitive layer has narrow peak sensitivity of from about 540 to about 560 nm, and the red sensitive layer has a peak sensitivity of from about 625, to about 655 nm, with a peak of from about 625 to about 645 nm being especially preferred. The specific sensitivities are enabled by the use of spectral sensitizing dyes as known in the art.

After imagewise exposure, chromogenic dye deposits will typically be formed during a development step that comprises contacting the color negative film with a basic solution and a paraphylene diamine color developing agent which reduces exposed silver halide to metallic silver and is itself oxidized. The oxidized color developing agent in turn reacts with a photographic coupler to form the chromogenic cyan, magenta and yellow dye images, all known in the art. The coupler may be introduced into the film during processing but is preferably present in the film before exposure and processing. The coupler may be monomeric or polymeric in nature. The magenta dye-forming couplers useful in the color photographic originating materials and particularly in the color negative films of this invention include the optionally substituted: 3-amidopyrazoles, the pyrazolotriazoles (particularly the pyrazolotriazole couplers disclosed in U.S. Pat. No. 5,254,446, incorporated by reference), and the 3-aminopyrazoles. The cyan dye-forming image couplers useful in the color photographic originating materials and particularly in the color negative films of this invention include the optionally substituted: phenols, 2-substituted-1-naphthols, 2,5-disubstituted-1-naphthols, and 2-(disubstituted carboxyanalide)-1-naphthols. The useful yellow dye forming couplers include the acetanalide and benzoylacetanalide couplers. While these dye image-forming couplers may have any equivalency known in the art, it is specifically contemplated that they be four equivalent couplers or preferably two equivalent couplers. The terms "equivalent" and "equivalency" indicate the formal stoichiometric relationship between the number of moles of silver reduced per mole of image dye formed in a coupling reaction. The color negative film may then be optionally desilvered using any technique known in the art. The image thus formed is borne on a support that is sufficiently transparent to enable the subsequent color printing step known in the art.

The components, assembly and processing of color negative film is described in detail at Research Disclosure Item 36544, 1994 and Research Disclosure Item 37038, 1995, both published by Kenneth Mason Publications, Ltd., The Old Harbormaster's, 8 North Street, Emsworth, Hampshire P010 7DD, England, the disclosures of which are incorporated by reference. Materials and methods useful in the preparation of color negative films are additionally described in T. H. James, Ed., "The Theory of the Photographic Process," Macmillan, New York, 1977, "The Kirk-Othmer Encyclopedia of Chemical Technology," John Wiley and Sons, New York, 1993, Neblette's "Imaging Processes and Materials," Van Nostrand Reinhold, New York, 1988, and Keller, Ed. "Science and Technology of Photography, VCH, New York, 1993. Typical color negative films illustrating art recognized practice in the layer order, formulation, manufacture and in the selection and use of components for such photographic elements include, but are by no means limited by, Gold Plus 100, Gold Ultra 400, Ektar 25, Ektar 1000, Vericolor III, Eastman High Speed Motion Picture Film all manufactured and sold by Eastman Kodak Company, and SH-100, SH-400 and SH-800 color negative films all manufactured and sold by Fuji Photo Film. The advantages of the current invention may be achieved by modifying any of these formulations to the extent necessary to conform to the requirements set forth in the specification. The exact magnitude of the benefits achieved will, of course, depend on the exact details of the formulations involved but these will be readily apparent to the skilled artisan.

Photographic elements useful in this invention can additionally include compounds capable of releasing photographically useful moieties, including but not limited to development inhibitor releasing (DIR) compounds, development accelerator releasing compounds, bleach accelerator releasing compounds, dye releasing compounds, scavengers, color masking compounds and such, as is known in the art, and as exemplified in the references cited herein. Also useful are both spatially fixed and solubilized preformed dyes that can be employed to control sensitivity, halation, light scatter, spectral response and as color printing and color balancing aids. The moieties thus released can be either ballasted in which case they remain localized at or near the point of release, they may be unballasted in which case they diffuse from the element during processing or they may be intermediately ballasted in which case they may partially diffuse through the element during processing.

In a preferred mode, the elements include DIR compounds. While any DIR compound can be employed in the practice of this invention, the DIR compounds that enable release of development inhibitor moieties lacking a free sulfur valence that can bind to silver are preferred since they enable improved desilvering of such films. In other words, it is preferred that the elements of this invention be substantially free of certain development inhibitors having a free valence that binds to silver. Such development inhibitors typically comprise a silver halide binding group having a sulfur, selenium or tellurium with a free valence that can form a bond with silver atoms, as well as a ballast moiety. The presence of such compounds appears to slow down the rate of desilvering (that is, bleaching or bleach-fixing) in the elements described herein, as compared to other classes of development inhibitors or where development inhibitors are completely absent. By "substantially free" is meant that the element at bleaching contains no more than about 0.003 mol of such development inhibitors per mol of silver and silver halide. In a preferred embodiment, the quantity of such development inhibitors is less than about 0.001 mol per mole of coated silver and silver halide. These relative quantities are best assured by controlling both the quantity of development inhibitor releasing (DIR) compounds and unblocked development inhibitors having the undesired characteristics as well as the quantity of silver halide during the preparation of the light sensitive element. In other words, before photographic development, the element should contain less than 0.003 mol total of both DIR compounds capable of releasing a development inhibitor having a free sulfur, selenium or tellurium valence that binds to silver and such development inhibitors themselves in unblocked form, per mol of silver halide. In a more preferred embodiment, this ratio should be less than about 0.001 mole per mole of silver halide. In such amounts, the development inhibitors do not significantly retard silver bleaching. In the practice of this invention, it is preferred to use development inhibitors having a heterocyclic nitrogen as a silver binding group, such as oxazoles, thiazoles, diazoles, triazoles, oxadiazoles, thiadiazoles, oxadiazoles, thitriazoles, benzotriazoles, tetrazoles, benzamidizoles, indazoles, isoindazoles, benzodiazoles or bensizodiazoles. The released development inhibitors can be stable in a processing solution or they can change in function and effect as a result of chemical reaction with components of the processing solutions.

The release compounds described above are preferably couplers and enable imagewise release of the photographically useful moieties. When these release compounds are couplers, they can form permanent dye deposits that substantially contribute to the image or they can form low extinction, fugitive or wash-out dyes, that is, they can be the so-called universal couplers. When the compounds are dye forming couplers, they can be in color complementary association to the spectral sensitivity of the light sensitive emulsions, that is, as a cyan dye forming coupler with a red light sensitive emulsion or they can be employed in mixed mode, for example as a yellow dye forming coupler with a green light sensitive emulsion. They can be coated in the same layer as the light sensitive silver halide emulsions or in the auxiliary layers so long as they are in reactive association with the light sensitive emulsions. The compounds can directly release the photographically useful moieties or they may release the photographically useful moieties in blocked form that in turn enables release of the moieties either by first order decay, as for example by electron-transfer down an optionally conjugated chain or by anchiameric release, or by reaction with other components present during a processing step. The release mechanisms can be used singly or in tandem as is known in the art. It is intended that these compounds be employed in reactive association with one another and with the image couplers all as known in the art. In a most preferred mode, the element will comprise both a DIR compound and a bleach accelerator releasing compound. When both are present, proper tone scale reproduction and excellent desilvering are achieved.

In assembling the light sensitive element of the invention, it is generally preferred to minimize the thickness of the element above the support so as to improve sharpness and improve access of processing solutions to the components of the element. For this reason, dry thicknesses of less than 30 μm are generally useful while thicknesses of from about 3 to about 25 μm are preferred and thicknesses of from about 7 to about 20 μm are even more preferred. These lowered thicknesses can be enabled at manufacture by use of surfactants and coating aids as is known in the art so as to control viscosity and shear. Both sharpness and ease of processing may be further improved by minimizing the quantity of incorporated silver in the element. While any useful quantity of light sensitive silver may be employed in the elements of this invention, total silver quantities of from about 1 to about 10 g/m$^2$ are contemplated and total silver of less than about 7 g/m$^2$ are preferred. Total silver of from about 1 to about 5 g/m$^2$ are even more preferred. The element useful in the process according to the invention may comprise in addition to emulsion (A), other AgCl, AgBr, AgClBr, AgClI, AgClBrI and AgBrI emulsions of morphologies and halide content and distribution as is known in the art. It is generally preferred that emulsion (A) together comprise at least 50 mole percent of the total silver halide in the elements of this invention, and in a more preferred mode at least 70 mole percent of the total silver halide and in a most preferred mode, at least 90 mole percent of the total silver halide of the element. It is preferred that the overall halide content and distribution of the element be controlled so as to ensure both rapid development and ease of subsequent desilvering. In this context, the element should comprise at least 30 mole percent chloride ion based on total silver, and preferentially comprise at least 50 mole percent chloride ion. It is more preferred that the element comprises at least 70 mole percent chloride ion and most preferred that it comprises at least 90 mole percent chloride ion. Overall iodide ion content should be less than about 10 mole percent iodide based on total included silver, more preferably less than about 5 mole percent iodide and most preferably less than about 3 mole percent iodide. The remainder of the halide can be bromide ion. Sharpness and color rendition in color images are further improved by complete removal of silver and silver halide from the element on processing. Since more swellable elements enable better access of components of processing solutions to the elements of this invention, swell ratios above about 1.25 are preferred, with swell ratios of from about 1.4 to about 6 being more preferred and swell ratios of from about 1.7 to about 3 being most preferred. Use of development, bleach, fix and bleach-fix accelerators as is known in the art and earlier described are additionally useful in this context. The balance of total thickness, total silver, total halide distribution and swell ratio most suitable for an element intended for a specific purpose being readily derived from the image structure, color reproduction, sensitivity, physical integrity and photographic resistance to pressure required for that purpose as is known in the art. These elements can be hardened as is known in the art.

The supports employed in this invention are flexible supports. While any suitable support may be employed for the color originating materials, and specifically the color negative films useful in the practice of the invention, it is specifically contemplated to employ transparent supports bearing magnetic information layers as described in Research Disclosure Item 34390, 1992 and in U.S. Pat. No. 5,252,441 and U.S. Pat. No. 254,449 the disclosures of which are incorporated by reference. Typical flexible supports include films of cellulose nitrate, cellulose acetate, polyvinylacetal, polyethylene terephthalate, polycarbonate and related resinous and polymeric materials. These supports can be of any suitable thickness and will preferably be less than about 150 μm thick, more preferably from about 50 to about 130 μm thick and most preferably from about 60 to about 110 μm thick.

It is desirable that a photographic element and a rapid development process provide sufficient sensitivity to be employed in a hand-held camera, that is have a sensitivity of at least ISO-25, have an average Status M gamma from about 0.5 to about 0.7 and preferably from about 0.55 to about 0.68, with each color record gamma being similar to the others. That is the gamma of the color units should exhibit a coefficient-of-variation (COV) of less than about 20%, preferably the COV of gammas should be less than about 17% and more preferably less than about 14%. These constraints enable ready printing of the formed image.

The term photographic image display material includes any light sensitive photographic material suitable for direct viewing by reflected light such as a color photographic paper, direct viewing by transmitted light such as a color photographic advertising transparency, or suitable for projected viewing such as a color photographic motion picture print film. Also included are those related materials typically employed as intermediate films suitable for preparing multiple copies of a display material.

Most generally, these photographic display materials will comprise a red light sensitive color record capable of forming a cyan dye deposit, a green light sensitive color record capable of forming a magenta dye deposit and a blue light sensitive color record capable of forming a yellow dye deposit. The red light color record will typically have a peak sensitivity at from about 690 to about 710 nm, the green light color record will typically have a peak sensitivity at about 545 and 555 nm. The peak sensitivity of the blue light color record useful in the practice of the current invention will be from about 450 to about 490 nm. The chromogenic dye deposits will typically be formed during a development step that comprises contacting the display material with a basic solution and a paraphylene diamine development agent to reduce silver halide to silver metal with concomitant production of an oxidized form of color developer. This oxidized color developer in turn reacts with a photographic coupler to form the chromogenic cyan, magenta and yellow dye images, all as is known in the art. The coupler may be introduced into the material during processing but is preferably present in the material before exposure and processing. The couplers may be monomeric or polymeric in nature. The magenta dye-forming couplers useful in the display material include the optionally substituted: 3-amidopyrazoles, the pyrazolotriazoles (particularly the pyrazolotriazole couplers disclosed in U.S. Pat. No. 5,254,446, incorporated by reference), and the 3-aminopyrazoles. The cyan dye-forming image couplers useful in the display materials invention include the optionally substituted: phenols, 2-substituted-1-naphthols, 2,5-disubstituted-1-naphthols, and 2-(disubstituted carboxyanalide)-1-naphthols. The useful yellow dye forming couplers include the acetanalide and benzoylacetanalide couplers. While these dye image-forming couplers may have any equivalency known in the art, it is specifically contemplated that they be four equivalent couplers or preferably two equivalent couplers. The development step may be amplified by the presence of peroxides as is known in the art. The display material may then be optionally desilvered using any technique known in the art. The display image may be borne on a reflective support, such as that used in color papers or on a transparent support such as that used in motion picture projection films.

The components, assembly and processing of color photographic display materials are described in detail in Research Disclosure Item 36544, 1994, and Item 37038, 1995, both noted above. Materials and methods useful in the preparation of color photographic display materials are additionally described in the publications noted above for originating elements. Materials useful in the preparation of color papers are further illustrated by current commercial practice as, for example, by EDGE, PORTRA or SUPRA Color Papers as sold by Eastman Kodak Company, by FUJI FA-family Color Papers as sold by Fuji Photo Film, by KONICA QA-family Color Papers as sold by Konica, by EASTMAN COLOR PRINT motion picture projection film as sold be Eastman Kodak Company, by AGFA MP-family motion picture print films as sold by Agfa-Gevaert, by DURATRANS and DURACLEAR display films as sold by Eastman Kodak Company and by KONSENSUS-II display films as sold by Konica.

The advantages of the current invention may be achieved by modifying any of these formulations to conform to the requirements set forth in the specification. The exact magnitude of the benefits achieved will, of course, depend on the exact details of the formulations involved but these will be readily apparent to the skilled practitioner. Most generally, display elements will contain from about 0.05 to about 3 g silver/$m^2$ of support and preferentially from about 0.2 to about 1 g silver/$m^2$ for a typical color paper. The photoactive layers of display elements will generally be thinner than those of the camera films described earlier while other characteristics, such as total halide distribution and swell ratio, will be similar to that described for the camera speed films.

Whether the light sensitive elements of this invention are color originating or color display materials, it is generally intended that they be supplied on spools or in cartridge form generally as is known in the art. When the element is supplied in spool form it may be wrapped about a core and enclosed in a removable housing with an exposed film leader as is known in the art. When the element is supplied in cartridge form, the cartridge may enclose a light sensitive photographic element in roll form and a housing surrounding the film to form a cartridge receptacle for protecting the film from exposure and an opening for withdrawing the film from the cartridge receptacle. It is further intended that such materials be supplied in a length that results in the element being forced to assume a radius of curvature of less than about 12,000 μm, and preferably a radius of curvature less than about 9,000 or 6,500 or even 6,000 μm or even less.

In another embodiment, the element may be supplied on similar or even less demanding spools and forced by a camera mechanism or the like through a constricted radius of curvature as small as 1,400 or even 1,000 μm. This severe curvature may occur in a consumer loadable camera or in a preloaded camera as is known in the art. These cameras can provide specific features as is known in the art such as shutter means, film advance means, waterproof housings, single or multiple lenses, lens selection means, variable aperture, focus or focal length lenses, means for monitoring lighting conditions, means for altering shutter times or lens characteristics based on lighting conditions or user provided instructions, and means for recording use conditions directly on the film. When the element is supplied in a preloaded camera, known also as a film with camera unit or a single use or recyclable camera, the camera may comprise a lens, a shutter, the element in roll form, means for holding the element in roll form prior to exposure, means for mounting a portion of the element for exposure through the lens, means for receiving portions of the element from the mounting means, and a housing for mounting the lens and shutter and for restricting light access to the film to that entering the camera through the lens.

Photographic Elements according to the current invention are particularly useful in Limited Use Cameras as described in recently allowed, commonly assigned U.S. patent application Ser. No. 135,700 filed 13 Oct., 1993, now U.S. Pat. No. 5,466,560 (Sowinski et al), the disclosure of which is incorporated by reference.

Processing generally includes a development step to reduce the imagewise exposed silver halide to metallic silver with concomitant oxidation of a color developing agent all as described in detail earlier. Any color developing agent that is suitable for use with low iodide, chloride containing elements may be used with this invention. These include aminophenols and paraphenylenediamines. While the concentration of developing agent to be employed in the practice of this invention can be any concentration known in the art, it is preferred that the concentration be from about 0.5 to about 200 mmol/l, with a concentration range from about 2 to about 80 mmol/l being preferred, a range from about 5 to about 65 mmol/l being more preferred and a concentration range from about 10 to about 60 mmol/l being most preferred. While the paraphenylene diamine developing agent is typically added to the developing solution directly, it may also be provided by incorporation in a blocked form directly in the light sensitive color element as described in U.S. Pat. No. 5,256,525. Alternatively, the blocked form of the developer may be employed in a replenisher element as described in U.S. Pat. No. 5,302,498. The structures of other useful paraphenylene diamine color developers may be found in U.S. Pat. No. 5,063,144 and U.S. Pat. No. 5,176,987.

Examples of aminophenol developing agents include o-aminophenol, p-aminophenol, 5-amino-2-hydroxytoluene, 2-amino-3-hydroxytoluene, and 2-hydroxy-3-amino-1,4-dimethylbenzene. Particularly useful primary aromatic amino developing agents are the p-phenylenediamines and especially the N,N-dialkyl-p-phenylenediamines in which the alkyl groups or the aromatic nucleus can be substituted or unsubstituted. Examples of useful p-phenylenediamine developing agents include: N,N-diethyl-p-phenylenediamine monohydrochloride, 4-N,N-diethyl-2-methylphenylyenediamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate and 4-N,N-diethyl-2,2'-methanesulfonylaminoethylphenylenediamine hydrochloride.

In addition to the primary aromatic amino color developing agent, the color developing solution may contain a variety of other agents such as alkalis to control pH, bromides, chlorides, iodides, benzyl alcohol, antioxidants, anti-foggants, solubilizing agents, brightening agents and so forth.

The photographic color developing composition may be employed in the form of aqueous alkaline working solutions having a pH of above about 7 and preferably in the range of from about 9 to about 13. The developer solution is preferably maintained at a pH of from about 9 to about 12 and most preferably maintained at a pH of from about 9.5 to about 11.5. To provide the necessary pH, they may contain one or more of the well known and widely used pH buffering agents, such as the alkali metal carbonates or phosphates. Potassium carbonate is especially preferred.

The contact time of the photographic element with the developer solution is from about 5 to about 150 seconds. Preferably, the contact time is from about 10 to about 120 seconds and most preferably the contact time is less than or equal to about 90 seconds. Shorter contact times tend to not allow for sufficient and even penetration of the developer solution into a photographic element while longer contact times result in poor sharpness thereby clearly defeating the intent of the current invention. Additionally, the shorter contact times enable improved image formation in multilayer, multicolor film elements by surprisingly enabling a greater homogeneity in extent of development between the imaging layers situated at different depths in the element.

The temperature of the development solution is typically regulated using means well known in the art at from about 25° C. and 65° C. Preferably, the temperature is maintained at from about 30° C. to about 55° C. and most preferably the temperature is maintained at from about 35° C. to about 45°C. Lower temperatures lead to excessively long development times thus defeating the purpose of the invention while higher temperatures lead to excessive fog growth and loss of image to fog discrimination that may alternatively be described as inferior signal-to-noise characteristics in the formed image.

The developer solution useful in the practice of this invention comprises bromide ion that can be provided as any of the known bromide salts including but not limited to potassium bromide, sodium bromide, lithium bromide and ammonium bromide. While bromide in trace amounts may be employed in the developer, the bromide ion concentration is generally maintained at a level greater than about 0.18 mmol/l. Improved layer to layer development homogeneity is more easily attained at higher bromide ion concentrations. While bromide ion concentration from about 0.25 to about 50 mmol/l may be employed for this purpose, a bromide ion concentration between about 1 and 28 mmol/l is preferred, and a bromide ion concentration from about 3 mmol/l to about 25 mmol/l is even more preferred. Lower levels of bromide can lead to an unsatisfactory imbalance in the extent of development of overlying and underlying layers in a multilayer, multicolor photographic element while higher levels of bromide can cause unwanted restraint of development. The higher levels of developer solution bromide ion useful in the practice of this invention are enabled by the surprisingly low extent of bromide for chloride ion metathesis encountered when developing the high chloride tabular grain emulsions required for the practice of this invention in the developer solutions of this invention.

It may additionally be useful to control the balance of developing agent and bromide ion in the practice of this invention. Most generally, the ratio of the concentration of developing agent to bromide ion should be from about 60:1 to about 1:2. It is preferable that the ratio of developing agent to bromide ion concentration be from about 50:1 to about 4:5 and more preferable that this ratio be from about 40:1 to about 9:10. It is most preferred that the ratio of developing agent concentration to bromide ion concentration in the developing solution be from about 30:1 to about 1:1.

These, and all other characteristics of process solutions and concentrations of components in process solutions mentioned throughout should be determined just before the light sensitive element comes into contact with the process solution. The contact time of an element with a process solution is the time elapsed from when the element first contacts the process solution to when the element is withdrawn from contact with the same process solution.

The developer solutions useful in the practice of this invention may additionally contain chloride ion. Chloride ion concentrations of from 0 to about 300 mmol/l are useful, with chloride ion concentrations from 0 to about 100 mmol/l being preferred. On extended use of the developer solution to develop high chloride emulsions, chloride levels of from about 15 to about 80 mmol/l may be typically encountered. Additionally, the developer solutions useful in the practice of this invention may include iodide ion as is known in the art. Trace quantities of iodide ion at concentrations from 0 to about 0.1 mmol/l are contemplated with iodide concentrations less than about 0.01 mmol/l being preferred.

Antioxidants such as hydroxylamine, dialkyl hydroxylamines, alkylsulfonate hydroxylamines, amidoalkylhydroxylamines, alkoxyalkylhydroxylamines alkanolamines, hydrazines and aminocarboxylic acids are additionally useful in the developer solutions of this invention at any concentration known in the art. While hydroxylamine is believed to behave as a mild developer for silver chloride emulsions, the halide ion incorporated in the developer solutions useful in the practice of this invention may generally be adequate to ameliorate such activity. The dialkyl hydroxylamines, alkanolamines and aminocarboxylic acids can be employed when such activity is objectionable. Useful dialkyl hydroxylamines, alkanolamines, hydrazines and aminocarboxylic acids are well know in the art and include diethyl hydroxylamine, ethanolamine and glycine as well as those illustrated in U.S. Pat. No. 3,287,125, U.S. Pat. No. 3,362,961, U.S. Pat. No. 4,892,804, U.S. Pat. No. 5,071,734, U.S. Pat. No. 4,978,786, U.S. Pat. No. 4,800,153, U.S. Pat. No. 4,801,516, U.S. Pat. No. 4,814,260, U.S. Pat. No. 4,876,174, U.S. Pat. No. 4,965,176, U.S. Pat. No. 4,966,834, U.S. Pat. No. 5,153,111, and U.S. Pat. No. 5,354,646 the disclosures of which are incorporated by reference. Two particularly useful antioxidants are bis (sulfonatoethyl)hydroxylamine and N-isopropyl-N-sulfonatoethylhydroxylamine.

The total quantity of amine antioxidants is preferably from about 0.5 to about 10 moles of antioxidant per mole of paraphenylene diamine developing agent. Inorganic antioxidants as are known in the art such as sulfite ion, bisulfite ion and the like are also useful. Typically these inorganic antioxidants are employed at art known useful concentrations. For example, less than about 50 mmol/l of sulfite or sulfite equivalent is generally found to be useful, with concentrations of less than about 16 mmol/l being preferred.

It may additionally be useful to incorporate sequestering agents for iron, calcium and the like, examples being aromatic polyhydroxy compounds, aminopolyphosphonic acids and aminopolycarboxylic acids. Additional compounds to improve clarity of the developer solution such as sulfonated polystyrenes as well as antistaining agents and wetting agents, all as disclosed in U.S. Pat. No. 4,892,804 are also recommended. Art recognized developing agent solubilizing aids such as p-toluenesulfonic acids are additionally recommended.

A typical developer solution useful in the practice of this invention may be formulated from 800 ml of water, 34.3 g of anhydrous potassium carbonate, 2.32 g of potassium bicarbonate, 0.38 g of anhydrous sodium sulfite, 2.96 g of sodium metabisulfite, 1.2 mg of potassium iodide, 1.31 g of sodium bromide, 8.43 g of diethylenetriaminepentaacetic acid pentasodium salt supplied as a 40% solution, 2.41 g of hydroxylamine sulfate, 4.52 g of N-(4-amino-3-methylphenyl)-N-ethyl-2-aminoethanol) as its sulfuric acid salt, and sufficient additional water and acid or base to make 1 liter of solution at a pH of 10.00 +/– 0.05 at 26.7° C.

Another typical developer useful in the practice of this invention may be formulated from 800 ml of water, 11 ml of 100% triethanolamine, 0.25 ml of 30% lithium polystyrene sulfonate, 0.24 g of anhydrous potassium sulfite, 2.3 g of BLANKOPHOR REU, 2.7 g of lithium sulfate, 0.8 ml of 60% 1-hydroxyethyl-1,1-diphosphonic acid, 1.8 g of potassium chloride, 0.3 g of potassium bromide, 25 g of potassium carbonate, 6 ml of 85% N,N-diethylhydroxylamine, 4.85 g of N-(4-amino-3-methylphenyl)-N-ethyl-2-aminoethyl-methanesulfonamide as its sesquisulfuric acid monohydrate salt, and sufficient additional water and acid or base to make 1 l of solution at a pH of 10.12 +/–0.05 at 25° C.

Yet another typical developer useful in the practice of this invention may be formulated from 800 ml of water, 5.5 ml of 100% triethanolamine, 0.25 ml of 30% lithium polystyrene sulfonate, 0.5 ml of 45% potassium sulfite, 1 g of BLANKOPHOR REU, 2 g of lithium sulfate, 0.6 ml of 60% 1-hydroxyethyl-1,1-diphosphonic acid, 0.6 ml of 40% diethylenetriaminepentaacetic acid pentasodium salt, 6 g of potassium chloride, 0.8 g of potassium bromide, 25 g of potassium carbonate, 3 ml of 85% N,N-diethylhydroxylamine, 3.8 g of N-(4-amino-3-methylphenyl)-N-ethyl-2-aminoethyl-methanesulfonamide as its sesquisulfuric acid monohydrate salt, and sufficient additional water and acid or base to make 1 liter of solution at a pH of 10.10 +/–0.05 at 25° C.

Still another useful developer may be formulated from 800 ml of water, 1 ml of 40% aminotris (methylenephosphonic acid) pentasodium salt, 4.35 g of anhydrous sodium sulfite, 1.72 g of anhydrous sodium bromide, 17.1 g of sodium carbonate monohydrate, 2.95 g of 4-N,N-diethyl-2-methylphenylenediamine as its hydrochloric acid salt, and sufficient additional water and acid or base to make 1 liter of solution at a pH of 10.53 +/–0.05 at 26.7° C.

An additional useful developer may be formulated from 600 ml of water, 2 ml of 40% aminotris (methylenephosphonic acid) pentasodium salt, 2 g of anhydrous sodium sulfite, 1.2 g of anhydrous sodium bromide, 30 g of sodium carbonate monohydrate, 0.22 g of 3,5-dinitrobenzoic acid, 4 g of N-(4-amino-3-methylphenyl)-N-ethyl-2-aminoethyl-methanesulfonamide as its sesquisulfuric acid monohydrate salt, 0.17 ml of sulfuric acid, and sufficient additional water and acid or base to make 1 liter of solution at a pH of 10.20 +/–0.05 at 26.7° C.

The development step may be followed by an optional treatment with an acidic stop bath, by one or more bleaching steps that serve to oxidize silver metal to either solubilized silver ion or to silver halide depending on the details of the bleaching solution formulation, by one or more fixing steps where a fixer solution solubilizes and removes silver halide from the element, by one or more washing steps, by stabilizing steps and by a drying step. The bleaching step and the fixing step may be combined in a bleach-fixing step.

Preferred methods of processing high chloride tabular grain light sensitive elements according to the invention are set forth in recently allowed and commonly assigned U.S. application Ser. No. 08/035,347 filed 22 Mar. 1993, now U.S. Pat. No. 5,443,943 (Szajewski et al); and in commonly assigned U.S. application No. Ser. 08/380,544 filed 30 Jan., 1995, the disclosures of which are incorporated by reference.

Processing according to the present invention can be carried out using conventional deep tanks holding processing solutions. Alternatively, it can be carried out using what is known in the art as "low volume thin tank" processing systems using either rack and rank or automatic tray designs. Such processing methods and equipment are described, for example, in recently allowed U.S. patent application Ser. No. 08/221,711 (filed Mar. 31, 1994, by Carli et al), now U.S. Pat. No. 5,436,118 and publications cited therein.

As used herein, the term "about" in defining amounts, temperatures, times and other conditions, refers to a variation of ±10% of the indicated values.

The following examples are intended to illustrate the practice of this invention. Unless otherwise indicated, all percentages are by weight.

EXAMPLE 1

This example illustrates the preparation of a multilayer multicolor color photographic element useful in the practice of the invention.

A color photographic recording material (Photographic Element 1) for color development was prepared by applying the layers listed below in the given sequence to a transparent support of cellulose triacetate. The quantities of silver halide are given in g of silver/$m^2$. The quantities of other materials are given in g/$m^2$.

Layer 1 {Antihalation Layer}: DYE-1 at 0.005, DYE-2 at 0.011, C-39 at 0.129, DYE-6 at 0.11, DYE-9 at 0.075, SOL-1 at 0.011, SOL-2 at 0.011, with gelatin at 2.15.

Layer 2 {Lowest Sensitivity Red-Sensitive Layer}: Red sensitive silver chloride {111}-faced iodide banded tabular grain emulsion, average equivalent circular diameter 1.0 μm, average thickness 0.07 μm (99.4 mol % chloride, 0.6 mol % iodide) at 0.140, C-8 at 0.66, D-32 at 0.0043, D-35 at 0.0161, C-42 at 0.065, ST-16 at 0.01, B-1 at 0.043, with gelatin at 1.30.

Layer 3 {Medium Sensitivity Red-Sensitive Layer}: Red sensitive silver chloride {111}-faced iodide banded tabular grain emulsion, average equivalent circular diameter 1.2 μm, average grain thickness 0.08 μm (99.4 mol % chloride, 0.6 mol % iodide) at 0.33, C-8 at 0.17, D-35 at 0.003, C-42 at 0.032, C-41 at 0.021, ST-16 at 0.01, with gelatin at 0.59.

Layer 4 {Highest Sensitivity Red-Sensitive Layer}: Red sensitive silver chloride {111}-faced iodide banded tabular grain emulsion, average equivalent circular diameter 1.3 μm, average grain thickness 0.09 μm (99.4 mol % chloride, 0.6 mol % iodide) at 0.70, C-8 at 0.052, D-32 at 0.001, D-35 at 0.002, C-42 at 0.022, C-41 at 0.011, ST-16 at 0.01, with gelatin at 1.18.

Layer 5 {Interlayer}: ST-4 at 0.11 with gelatin at 0.75.

Layer 6 {Lowest Sensitivity Green-Sensitive Layer}: Green sensitive silver chloride {111}-faced iodide banded tabular grain emulsion, average equivalent circular diameter 1.0 μm, average grain thickness 0.07 μm (99.4 mol % chloride, 0.6 mol % iodide) at 0.16, C-2 at 0.28, D-34 at 0.011, D-35 at 0.002, C-40 at 0.065, ST-5 at 0.07, ST-16 at 0.01, with gelatin at 0.95.

Layer 7 {Medium Sensitivity Green-Sensitive Layer}: Green sensitive silver chloride {111}-faced iodide banded tabular grain emulsion, average equivalent circular diameter 1.4 μm, average grain thickness 0.12 μm (99.4 mol % chloride, 0.6 mol % iodide) at 0.32, C-2 at 0.043, D-34 at 0.001, D-35 at 0.007, C-40 at 0.022, ST-5 at 0.01, ST-16 at 0.01, with gelatin at 0.59.

Layer 8 {Highest Sensitivity Green-Sensitive Layer}: Green sensitive silver chloride {111}-faced iodide banded tabular grain emulsion, average equivalent circular diameter 2.3 μm, average grain thickness 0.8 μm (99.4 mol % chloride, 0.6 mol % iodide) at 0.70, C-2 at 0.065, C-40 at 0.022, D-35 at 0.002, ST-16 at 0.01, with gelatin at 1.18.

Layer 9 {Interlayer}: ST-4 at 0.11 with gelatin at 0.75.

Layer 10 {Lowest Sensitivity Blue-Sensitive Layer}: Blue sensitive silver chloride {111}-faced iodide banded tabular grain emulsion with average equivalent circular diameter of 0.6 μm and average grain thickness of 0.1 μm (99.4 mol % chloride, 0.6 mol % iodide) at 0.15, and a blue sensitive silver chloride {111}-faced iodide banded tabular grain emulsion with average equivalent circular diameter of 1.1 μm and average grain thickness of 0.08 μm (99.4 mol % chloride, 0.6 mol % iodide) at 0.07, C-27 at 0.22, C-29 at 0.7, D-34 at 0.001, D-35 at 0.004, ST-16 at 0.01, with gelatin at 1.5.

Layer 11 {Highest Sensitivity Blue-Sensitive Layer}: Blue sensitive silver chloride {111}-faced banded iodide tabular grain emulsion with average equivalent circular diameter of 2.3 μm and average grain thickness of 0.08 μm (99.4 mol % chloride, 0.6 mol % iodide) at 0.86, C-27 at 0.043, C-29 at 0.13, D-34 at 0.001, D-35 at 0.001, ST-16 at 0.01, with gelatin at 1.29.

Layer 12 {Protective Layer-1}: DYE-8 at 0.1, DYE-9 at 0.1, and gelatin at 0.7.

Layer 13 {Protective Layer-2}: silicone lubricant at 0.04, tetraethylammonium perfluoro-octane sulfonate, anti-matte polymethylmethacrylate beads at 0.11, soluble anti-matte polymethacrylate beads at 0.005, and gelatin at 0.89.

The elements' layers were hardened at coating with 2% by weight to total gelatin of hardener. The organic compounds were used as emulsions containing coupler solvents, surfactants and stabilizers or used as solutions both as commonly practiced in the art. The coupler solvents employed in this element included: tricresylphosphate, di-n-butyl phthalate, di-N-butyl sebacate, N,N-di-n-ethyl lauramide, N,N-di-n-butyl lauramide, 2,4-di-t-amylphenol, N-butyl-N-phenyl acetamide, and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, 1,3-butanediol, 4-hydroxy-6-methyl-1,3,3a,7-tetraazaindene and disodium-3,5-disulfocatechol. The silver halide emulsions employed in this element all comprised a silver chloride core with a surrounding iodide band, and comprised about 0.6 mol % bulk iodide. These were generally prepared following the procedures described in U.S. Pat. No. 5,035,992, U.S. Pat. No. 5,217,858, and U.S. Pat. No. 5,389,509, all incorporated by reference, followed by a washing step to remove the organic stabilizer compound. Other surfactants, coating aids, scavengers, soluble absorber dyes and stabilizers as well as various iron, lead, gold, platinum, palladium, iridium and rhodium salts were optionally added to the various emulsions and layers of this element as is commonly practiced in the art. The total dry thickness of all the applied layers above the support was about 19 μm while the thickness from the innermost face of the sensitized layer closest to the support to the outermost face of the sensitized layer furthest from the support was about 15 μm.

TABLE I

| COMPOUND | LITERATURE SOURCE |
|---|---|
| DYE 1 | Allowed USSN 08/0.35,347, now U.S. Pat. No. 5,443,943 (Szajewski et al), incorporated by reference 4 |
| DYE 2 | Allowed USSN 08/0.35,347, incorporated by reference 4 |
| DYE 6 | Allowed USSN 08/0.35,347, incorporated by reference 4 |
| DYE 7 | Allowed USSN 08/0.35,347, incorporated by reference 4 |
| DYE 8 | Allowed USSN 08/0.35,347, incorporated by reference 4 |
| DYE 9 | Allowed USSN 08/0.35,347, incorporated by reference 4 |
| C-1 coupler | Allowed USSN 08/0.35,347, incorporated by reference 4 |
| C-2 coupler | Allowed USSN 08/0.35,347, incorporated by reference 4 |
| C-8 coupler | Allowed USSN 08/0.35,347, incorporated by reference 4 |
| C-27 coupler | Allowed USSN 08/0.35,347, incorporated by reference 4 |
| C-29 coupler | Allowed USSN 08/0.35,347, incorporated by reference 4 |
| C-39 dye releasing compound | Allowed USSN 08/0.35,347, incorporated by reference 4 |
| C-40 dye releasing compound | Allowed USSN 08/0.35,347, incorporated by reference 4 |
| C-41 dye releasing compound | Allowed USSN 08/0.35,347, incorporated by reference 4 |
| C-42 dye releasing compound | Allowed USSN 08/0.35,347, incorporated by reference 4 |
| B-1 Bleach accelerator | Allowed USSN 08/0.35,347, incorporated by reference 4 |
| D-1 DIR coupler | Allowed USSN 08/0.35,347, incorporated by reference 4 |
| D-4 DIR coupler | Allowed USSN 08/0.35,347, incorporated by reference 4 |
| D-35 DIR coupler | Allowed USSN 08/0.35,347, incorporated by reference 4 |
| D-16 DIR coupler | Allowed USSN 08/0.35,347, incorporated by reference 4 |
| D-20 DIR coupler | Allowed USSN 08/0.35,347, incorporated by reference 4 |
| D-34 DIR coupler | Allowed USSN 08/0.35,347, incorporated by reference 4 |
| ST-4 | Research Disclosure publication 37038, 1995, pages 79–115, incorporated by reference |
| ST-5 | Research Disclosure publication 37038, 1995, pages 79–115, incorporated by reference |
| ST-16 | Research Disclosure publication 37038, 1995, pages 79–115, incorporated by reference |
| SOL-1 | Allowed USSN 08/035, 347 now U.S. Pat. No. 5,443,943 (noted above) |
| SOL-2 | Allowed USSN 08/035, 347 now U.S. Pat. No. 5,443,943 (noted above) |

Comparative Photographic Element 2 was a commercially available, ISO 200 sensitivity, color negative camera speed film that employed similar sized {111} silver iodobromide emulsions prepared generally following the directions of Kofron et al (noted above) but was otherwise similar in silver incorporation and components to Photographic Element 1 useful in the practice of the invention.

EXAMPLE 2

This example describes processing of photographic elements and illustrates that the element of the invention exhibited both adequate sensitivity and homogeneous development in all light sensitive layers while the prior art comparative element failed in these characteristics.

Portions of Photographic Elements 1 and 2 were exposed to light through a graduated density test object, and processed as follows:

| | | | |
|---|---|---|---|
| Development | (as in Table II) | | 38° C. |
| Bleaching | 240 Seconds | Bleach-I | 38° C. |
| Washing | 180 Seconds | Water | 35° C. |

-continued

| | | | |
|---|---|---|---|
| Fixing | 240 Seconds | Fix-I | 38° C. |
| Washing | 180 Seconds | Water | 35° C. |
| Rinsing | 60 Seconds | Rinse | 35° C. |

Developer-I was formulated by adding water, 34.3 g of potassium carbonate, 2.32 g of potassium bicarbonate, 0.38 g of anhydrous sodium sulfite, 2.96 g of sodium metabisulfite, 1.2 g of potassium iodide, 1.31 g of sodium bromide, 8.43 g of a 40% solution of diethylenetriamine-pentaacetic acid pentasodium salt, 2.41 g of hydroxylamine sulfate, 4.52 g of (N-(4-amino-3-methylphenyl)-N-ethyl-2-aminoethanol) as its sulfuric acid salt and sufficient additional water and sulfuric acid or potassium hydroxide to make 1 liter of solution at a pH of 10.00 +/−0.05 at 26.7° C.

Developer-II was generally like Developer-I except that the bromide level was adjusted to about 3.1 mmol/l.

Developer-III was generally like Developer-I except that the color developing agent level was adjusted to about 61.9 mmol/l.

Developer-IV was generally like Developer-I except that the bromide level was adjusted to about 3.1 mmol/l and the color developing agent level was adjusted to about 61.9 mmol/l.

Developer-V was generally like Developer-I except that the bromide level was adjusted to about 0.17 mmol/l and the color developing agent level was adjusted to about 11.5 mmol/l.

Bleach-I was formulated by adding water, 37.4 g of 1,3-propylenediamine tetraacetic acid, 70 g of a 57% ammonium hydroxide solution, 80 g of acetic acid, 0.8 g of 2-hydroxy-1,3-propylenediamine tetraacetic acid, 25 g of ammonium bromide, 44.85 g of ferric nitrate nonahydrate and sufficient water and acid or base to make 1 liter of solution at a pH of 4.75.

Fix-I was formulated by adding water, 214 g of a 58% solution of ammonium thiosulfate, 1.29 g of (ethylenedinitrilo)tetraacetic acid disodium salt dihydrate, 11 g of sodium metabisulfite, 4.7 g of a 50% solution of sodium hydroxide and sufficient water and acid or base to make 1 liter of solution at a pH 6.5.

The "Status M gamma" (that is, the change in density as a function of change in exposure) produced in each color unit of each element was determined for each run. From these, the average gamma and the standard deviation in gamma were determined for each experimental run, that is, for each experimental combination of a film element, developer composition and development contact time. The coefficient of variation (COV) in gamma was then determined for each run. The film light sensitivity, expressed as ISO speed was also determined for each run. These results are listed in Table II, below.

TABLE II

| Run | Element | Developer Solution | Time (sec) | Bromide Ion Conc. | Developing Agent Concentration | Sensitivity Greater Than ISO 25? | Average Gamma | COV Gamma |
|---|---|---|---|---|---|---|---|---|
| 1 | 2 | I | 195 | ~12.5 mM | ~15.5 mM | YES | 0.61 | 6.2% |
| 2 | 2 | I | 90 | ~12.5 mM | ~15.5 mM | YES | 0.37 | 9.4% |
| 3* | 1 | I | 90 | ~12.5 mM | ~15.5 mM | YES | 0.56 | 13.2% |
| 4 | 2 | II | 90 | ~3.1 mM | ~15.5 mM | YES | 0.40 | 8.7% |
| 5* | 1 | II | 90 | ~3.1 mM | ~15.5 mM | YES | 0.57 | 6.3% |
| 6 | 2 | III | 60 | ~12.5 mM | ~61.9 mM | YES | 0.42 | 17.6% |
| 7* | 1 | III | 60 | ~12.5 mM | ~61.9 mM | YES | 0.60 | 9.3% |
| 8 | 2 | IV | 45 | ~3.1 mM | ~61.9 mM | YES | 0.24 | 35.0% |
| 9* | 1 | IV | 45 | ~3.1 mM | ~61.9 mM | YES | 0.59 | 5.2% |
| 10 | 2 | V | 45 | ~0.17 nM | ~11.5 mM | NO | 0.11 | 60.5% |
| 11 | 1 | V | 45 | ~0.17 mM | ~11.5 mM | YES | 0.54 | 29.6% |

*Invention

It is desirable that a photographic element after a rapid development process retain sufficient sensitivity to be employed in a hand-held camera, that is, have a sensitivity of at least ISO-25, have a gamma of about 0.60 and have a coefficient-of-variation (COV) of less than about 20%. As is readily apparent, only the film samples (3, 5, 7 and 9) employing the high chloride emulsions and developed at the balanced bromide and developing agent concentrations required for the practice of the invention were capable of simultaneously enabling acceptable light sensitivity, acceptable gamma formation and balanced gamma formation between color records after a rapid development process. The prior art sample uniformly failed under all the conditions tested and even the sample employing the {111} tabular grains failed in the low bromide developer solution.

EXAMPLE 3

This example illustrates the preparation of control Element 101 comprising a {111}-faced high chloride tabular grain emulsion lacking the bromide or iodide band required in the practice of this invention and which retains the organic grain growth modifier and surface stabilizer required for both formation and morphological stabilization of the grain surface. It also illustrates the preparation of Element 102 comprising a {111}-faced high chloride tabular grain emulsion comprising the bromide or iodide band required in the practice of this invention and from which the organic grain growth modifier has been removed. This example further illustrates the improved desilvering observed with elements employing the {111} faced emulsions useful in the practice of this invention.

Elements 101 and 102 were each prepared by applying to a transparent support:

a) an antihalation layer comprising grey silver and gelatin, b) an emulsion layer comprising a chemically and spectrally sensitized {111} faced high chloride emulsion as described below, a cyan dye-forming image coupler and gelatin, and c) a hardened overcoat layer comprising gelatin and surfactants.

Element 101 comprised a chemically and spectrally sensitized AgCl {111}-faced tabular grain emulsion having an average equivalent circular diameter of about 1.1 μm and an average grain thickness of about 0.09 μm, which was prepared in the presence of 4,5,6-triaminopyrimidine as grain growth modifier and which retained the 4,5,6-triaminopyrimidine as a grain surface stabilizer following the directions given by the Maskasky patent (noted above).

Element 102 was like Element 101 except that the emulsion was replaced by a like-sized chemically and spectrally sensitized AgClI {111}-faced tabular grain emulsion comprising about 0.5 mole % iodide as a band with the remainder of the emulsion halide being chloride. The emulsion was prepared using 7-azaindole as the grain growth modifier and the 7-azaindole was removed by washing before the emulsion was applied to form the element. This emulsion is useful in the practice of the present invention.

Elements 101 and 102 were exposed to white light through a graduated density test object, developed in Developer-I as described above and desilvered using a bleach/fixing solution for 45 seconds at about 38° C. followed by a water wash and drying.

The bleach/fixing solution was prepared by adding to water, 80 ml of a 58% aqueous solution of ammonium thiosulfate, 7.5 g of sodium sulfite, 75 ml of a 44% aqueous solution of ammonium ferric ethylenediaminetetraacetic acid and enough water, acid or base to make 1 liter of solution with a pH of about 6.2.

After drying, the residual silver and silver halide retained in both elements was measured using conventional X-ray fluorescence. Control Element 101 retained 14% more silver than did Element 102. This result is especially surprising since the emulsion employed in Element 102 contains iodide while the emulsions employed in Element 101 was free of iodide. Emulsion iodide is well known in the art to interfere with desilvering. The retained silver provides unwanted black density in the element and interferes with subsequent color printing steps. This demonstrates the unsuitability of the widely known {111} high chloride emulsions lacking the bromide or iodide band structure and retaining the grain growth modifier or morphological stabilizer for use in the practice of the current invention.

EXAMPLE 4

This example illustrates the preparation of multilayer multicolor color photographic elements useful in the practice of the invention.

A color photographic recording material (Photographic Element 3) for color development was prepared by applying the following layers in the given sequence to a transparent support of cellulose triacetate. The quantities of silver halide are given in g of silver/$m^2$. The quantities of other materials are given in g/$m^2$.

Layer 1 {Antihalation Layer}: DYE-1 at 0.011, DYE-2 at 0.022, C-39 at 0.098, DYE-6 at 0.11, DYE-9 at 0.075, SOL-1 at 0.011, SOL-2 at 0.011, with gelatin at 2.15.

Layer 2 {Lowest Sensitivity Red-Sensitive Layer}: Red sensitive silver chloride {111}-faced iodide banded tabular grain emulsion, average equivalent circular diameter 1.0 μm, average thickness 0.07 μm (99.4 mol % chloride, 0.6 mol % iodide) at 0.140, C-1 at 0.54, D-20 at 0.022, C-42 at 0.097, ST-16 at 0.01, B-1 at 0.043, with gelatin at 1.30.

Layer 3 {Medium Sensitivity Red-Sensitive Layer}: Red sensitive silver chloride {111}-faced iodide banded tabular grain emulsion, average equivalent circular diameter 1.2 μm, average grain thickness 0.08 μm (99.4 mol % chloride, 0.6 mol % iodide) at 0.33, C-1 at 0.13, D-20 at 0.0054, C-42 at 0.032, C-41 at 0.021, ST-16 at 0.01, with gelatin at 0.59.

Layer 4 {Highest Sensitivity Red-Sensitive Layer}: Red sensitive silver chloride {111}-faced iodide banded tabular grain emulsion, average equivalent circular diameter 1.3 μm, average grain thickness 0.09 μm (99.4 mol % chloride, 0.6 mol % iodide) at 0.75, C-1 at 0.043, D-20 at 0.005, C-42 at 0.022, C-41 at 0.011, ST-16 at 0.01, with gelatin at 0.83.

Layer 5 {Interlayer}: ST-4 at 0.11 with gelatin at 1.08.

Layer 6 {Lowest Sensitivity Green-Sensitive Layer}: Green sensitive silver chloride {111}-faced iodide banded tabular grain emulsion, average equivalent circular diameter 1.0 μm, average grain thickness 0.07 μm (99.4 mol % chloride, 0.6 mol % iodide) at 0.16, C-2 at 0.28, D-16 at 0.011, D-1 at 0.011, C-40 at 0.097, ST-5 at 0.07, ST-16 at 0.01, with gelatin at 0.95.

Layer 7 {Medium Sensitivity Green-Sensitive Layer}: Green sensitive silver chloride {111}-faced iodide banded tabular grain emulsion, average equivalent circular diameter 1.4 μm, average grain thickness 0.12 μm (99.4 mol % chloride, 0.6 mol % iodide) at 0.32, C-2 at 0.054, D-16 at 0.0005, D-1 at 0.011, C-40 at 0.027, ST-5 at 0.011, ST-16 at 0.01, with gelatin at 0.59.

Layer 8 {Highest Sensitivity Green-Sensitive Layer}: Green sensitive silver chloride {111}-faced iodide banded tabular grain emulsion, average equivalent circular diameter 2.3 μm, average grain thickness 0.8 μm (99.4 mol % chloride, 0.6 mol % iodide) at 0.70, C-2 at 0.065, C-40 at 0.027, D-16 at 0.0005, ST-5 at 0.016, ST-16 at 0.01, with gelatin at 0.86.

Layer 9 {Interlayer}: ST-4 at 0.11, DYE-7 as a solid particle dye dispersion at 0.008, with gelatin at 1.08.

Layer 10 {Lowest Sensitivity Blue-Sensitive Layer}: Blue sensitive silver chloride {111}-faced iodide banded tabular grain emulsion with average equivalent circular diameter of 0.6 μm and average grain thickness of 0.1 μm (99.4 mol % chloride, 0.6 mol % iodide) at 0.15, and a blue sensitive silver chloride {111}-faced iodide banded tabular grain emulsion with average equivalent circular diameter of 1.1 μm and average grain thickness of 0.08 μm (99.4 mol % chloride, 0.6 mol % iodide) at 0.11, C-27 at 0.22, C-29 at 0.7, D-4 at 0.011, ST-16 at 0.01, with gelatin at 1.5.

Layer 11 {Highest Sensitivity Blue-Sensitive Layer}: Blue sensitive silver chloride {111}-faced banded iodide tabular grain emulsion with average equivalent circular diameter of 2.3 μm and average grain thickness of 0.08 μm (99.4 mol % chloride, 0.6 mol % iodide) at 0.86, C-27 at 0.043, C-29 at 0.13, D-4 at 0.003, ST-16 at 0.01, with gelatin at 0.99.

Layer 12 {Protective Layer-1}: DYE-8 at 0.1, DYE-9 at 0.1, and gelatin at 0.7.

Layer 13 {Protective Layer-2}: silicone lubricant at 0.04, tetraethylammonium perfluorooctane sulfonate, anti-matte polymethylmethacrylate beads at 0.11, soluble anti-matte polymethacrylate beads at 0.005, and gelatin at 0.89.

This element comprised additional components as in Photographic Element 1 described earlier. The total dry thickness of all the applied layers above the support was about 20 μm while the thickness from the innermost face of the sensitized layer closest to the support to the outermost face of the sensitized layer furthest from the support was about 16 μm.

Photographic Element 4 was like Photographic Element 3 except that DIR compound D-20 was omitted from layers 2, 3 and 4 and was replaced by DIR compound D-32 at 0.016, 0.003 and 0.003 respectively, and DIR compound D-16 was omitted from layers 6, 7 and 8 and replaced by DIR compound D-34 at 0.021, 0.007 and 0.003 respectively. These quantities were chosen so as to maintain gamma.

Photographic Element 5 was like Photographic Element 4 except that Bleach Accelerator Releasing Compound B-1 was omitted from layer 2.

Photographic Elements 6 and 7 were like Photographic Elements 3 and 4 except the {111} high chloride banded iodide emulsions were each replaced by like quantities of similarly sized and sensitized {100} high chloride banded iodide emulsions of like halide content prepared generally following the procedures of U.S. Pat. No. 5,314,798 (Brust et al).

The characteristics of these elements are summarized in Table III, shown as part of the next example.

EXAMPLE 5

This example describes a color negative processing of the photographic elements described above and illustrates that the element containing the {111} high chloride banded iodide tabular grain emulsions useful in the practice of the invention exhibited excellent desilvering properties relative to both the {111} bromoiodide tabular emulsions known in the art and to the {100} banded iodide tabular grain emulsions.

Samples of Photographic Elements 2 through 7 were exposed to light through a graduated density test object and processed as follows:

| | | | |
|---|---|---|---|
| Developing | 90 seconds | DEVELOPER-I | 38° C. |
| Bleach-fixing | 45 seconds | BLEACH-FIX | 38° C. |
| Washing and drying. | | | |

The quantity of silver retained in each element was measured using the conventional X-ray fluorescence technique. These retained silver values are listed in Table II along with the characteristics of the elements tested.

TABLE III

| Element | Emulsion type | Inhibitor type | Bleach Accelerator? | Retained silver (g/m$^2$) |
|---|---|---|---|---|
| 2 | {111}AgIBr | S-valence | yes | 0.337 |
| 3 | {111}AgICl | S-valence | yes | 0.103 |
| 4 | {111}AgICl | N-valence | yes | 0.072 |
| 5 | {111}AgICl | N-valence | no | 0.349 |
| 6 | {100}AgICl | S-valence | yes | 0.157 |
| 7 | {100}AgICl | N-valence | yes | 0.130 |

These data demonstrate the utility of a bleach accelerator compound for excellent desilvering of the elements prepared with the {111} high chloride banded iodide emulsions. These data further illustrate the benefit of limiting or fully avoiding both {111} bromoiodide tabular grain emulsions and the sulfur valence development inhibitors. In addition, these data illustrate the surprising improvement in desilvering properties of the {111} banded iodide, high chloride tabular emulsions relative to the closely related {100} banded iodide, high chloride tabular grain emulsions.

The invention has been described in detail with particular reference to preferred embodiments thereof, but it will be understood that variations and modifications can be effected within the spirit and scope of the invention.

I claim:

1. A light sensitive color photographic element comprising a support having thereon a red light-sensitive color record comprised of a red sensitized silver halide emulsion, a green light-sensitive color record comprised of a green sensitized silver halide emulsion, and a blue light-sensitive color record comprised of a blue sensitized silver halide emulsion, each of said color records having a chemically and spectrally sensitized emulsion (A), wherein:

emulsion (A) comprises a tabular silver halide emulsion population comprised of at least 50 mol % chloride, based on silver, wherein at least 50% of the grain population projected area is accounted for by tabular grains bounded by {111} major faces, each tabular grain having an aspect ratio of at least 2 and each being comprised of a core and a surrounding band containing a higher level of iodide ion than is present in said core, said band containing up to about 30% of the silver in the tabular grain, and said tabular grains having a thickness of less than about 0.3 micrometers;

wherein said emulsion (A) has been precipitated in the presence of an organic grain growth modifier or surface stabilizer, and wherein at least 95% of said organic grain growth modifier or stabilizer has been removed from said emulsion (A) after the formation of said band, wherein the total iodide content of all of the silver halide emulsions is no more than about 5 mol % based on total silver, wherein said element comprises from about 1 to about 10 grams of silver/m$^2$, and wherein said element has a light sensitivity of at least ISO-25.

2. The element of claim 1 further comprising a compound selected from the group consisting of: a dye releasing compound, a development inhibitor releasing compound, a bleach accelerator releasing compound and a color masking compound.

3. The element of claim 1 wherein the element is a color negative element.

4. The element of claim 1 wherein the element further comprises a magnetic recording layer.

5. The element of claim 1 wherein said element is substantially free of a development inhibitor or a development inhibitor releasing compound capable of releasing a development inhibitor comprising a silver halide binding group chosen from the group consisting of a sulfur, selenium or tellurium with a free valence that can form a bond with silver atoms.

6. The element of claim 1 wherein at least about 50% of the total incorporated silver halide is accounted for by one or more emulsion (A).

7. The element of claim 1 wherein said silver halide emulsion grains have a thickness of greater than about 0.01 μm.

8. The element of claim 1 wherein said silver halide emulsion grains have an aspect ratio of greater than about 8 and less than about 100.

9. The element of claim 1 wherein said band contains from about 0.2 to about 3 percent of the silver in said tabular grain.

* * * * *